US005898149A

United States Patent [19]

Berger et al.

[11] Patent Number: 5,898,149

[45] Date of Patent: Apr. 27, 1999

[54] POWER CIRCUIT-BREAKER

[75] Inventors: Ernst Berger, Mellingen; Christian Lindner, Zürich, both of Switzerland

[73] Assignee: Asea Brown Boveri AG, Baden, Switzerland

[21] Appl. No.: 08/662,939

[22] Filed: Jun. 12, 1996

[30] Foreign Application Priority Data

Sep. 30, 1995 [DE] Germany ..... 195 36 673

[51] Int. Cl.[6] ..... H01H 33/88; H01H 33/04

[52] U.S. Cl. ..... 218/60; 218/61; 218/66; 218/84

[58] Field of Search ..... 218/59, 62, 57, 218/66, 45, 43, 47, 51, 52, 78, 84, 88, 154

[56] References Cited

U.S. PATENT DOCUMENTS

| | | | |
|---|---|---|---|
| 4,329,553 | 5/1982 | Graf | 200/148 A |
| 4,524,257 | 6/1985 | Slamecka | 200/148 A |
| 5,478,980 | 12/1995 | Freeman et al. | 218/59 |
| 5,561,280 | 10/1996 | Blatter | 218/59 |
| 5,587,571 | 12/1996 | Perret | 218/60 |
| 5,589,673 | 12/1996 | Lehmann et al. | 218/66 |
| 5,600,111 | 2/1997 | Dufournet | 218/61 |

FOREIGN PATENT DOCUMENTS

| | | |
|---|---|---|
| 0374384B1 | 6/1990 | European Pat. Off. . |
| 3310142A1 | 4/1984 | Germany . |
| 3440857 | 5/1986 | Germany . |
| 9308586 | 12/1993 | Germany . |
| 4025553C2 | 3/1994 | Germany . |

*Primary Examiner*—Wynn Wood Coggins
*Assistant Examiner*—Michael J. Hayes
*Attorney, Agent, or Firm*—Burns, Doane, Swecker & Mathis, L.L.P.

[57] ABSTRACT

This power circuit-breaker has at least one cylindrically constructed arcing chamber which is provided with a stationary contact, with a moving contact and with a quenching zone between the two contacts. A shaft of the moving contact is permanently connected to a blowout volume which is closed off on the stationary contact side by an insulating nozzle through which at least one flow channel passes. The arcing chamber has a first compression volume which is operatively connected to the blowout volume and to a second compression volume. It is intended to provide a power circuit-breaker in which the blowing-out of the arc with pure $SF_6$ gas is made stronger. This is achieved by providing a moving auxiliary piston between the first compression volume and the second compression volume and by the auxiliary piston being connected to the moving contact via a direction-changing device.

9 Claims, 5 Drawing Sheets

POWER CIRCUIT-BREAKER

BACKGROUND OF THE INVENTION

1. Field of the Invention

The invention is based on a power circuit-breaker according to the preamble of claim 1.

2. Discussion of Background

Patent Specification EP 0 374 384 31 discloses a power circuit-breaker which is filled with $SF_6$ gas. In the case of this power circuit-breaker, the quenching gas which is required for blowing out the arc is produced on the one hand by the arc itself and on the other hand, in addition, by a piston/cylinder arrangement. The piston/cylinder arrangement has a stationary piston. The pressure which is produced by compression in this piston/cylinder arrangement rises approximately in proportion to the travel of the moving cylinder, provided no pressure flows out of the piston/cylinder arrangement during the compression period.

In the case of this power circuit-breaker, only that pure $SF_6$ gas which is already present in the piston/cylinder arrangement at the start of disconnection is compressed in the compression period during the disconnection process. If it is intended to increase further the disconnection capacity, then this could admittedly be achieved with the aid of an enlarged piston/cylinder arrangements but this would lead to an arcing chamber of larger dimensions, which would considerably increase the cost of the power circuit-breaker. In addition, a larger piston/cylinder arrangement would also require a stronger and thus more expensive drive.

SUMMARY OF THE INVENTION

Accordingly, one object of the invention, as described in the independent claims, is to provide a novel power circuit-breaker in which the blowing-out of the arc with pure $SF_6$ gas is made stronger, using simple means.

In the case of the power circuit-breaker according to the invention, the disconnection power is advantageously increased by the arc being blown out more strongly. In particular, the disconnection capacity of the power circuit-breaker is also considerably improved in the region of comparatively small currents. In the case of the present power circuit-breaker, a larger quantity of pure $SF_6$ gas is available for blowing out the arc than in the case of conventional power circuit-breakers, this resulting in the considerable increase in the disconnection capacity, and the cost for this improvement is comparatively small in this case.

The arcing chamber of the power circuit-breaker can be used in any required mounting position, that is to say it can be used advantageously both for all possible open-air applications and in metal-encapsulated, gas-insulated, high-voltage installations.

The further refinements of the invention are the subject matter of the dependent claims.

The invention, its development and the advantages which can be achieved thereby are explained in more detail in the following text, with reference to the drawing, which illustrates only one possible embodiment options

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

The figures show only those elements which are required for direct understanding of the invention.

DESCRIPTION OF THE PREFERRED EMBODIMENTS

Figure 1:
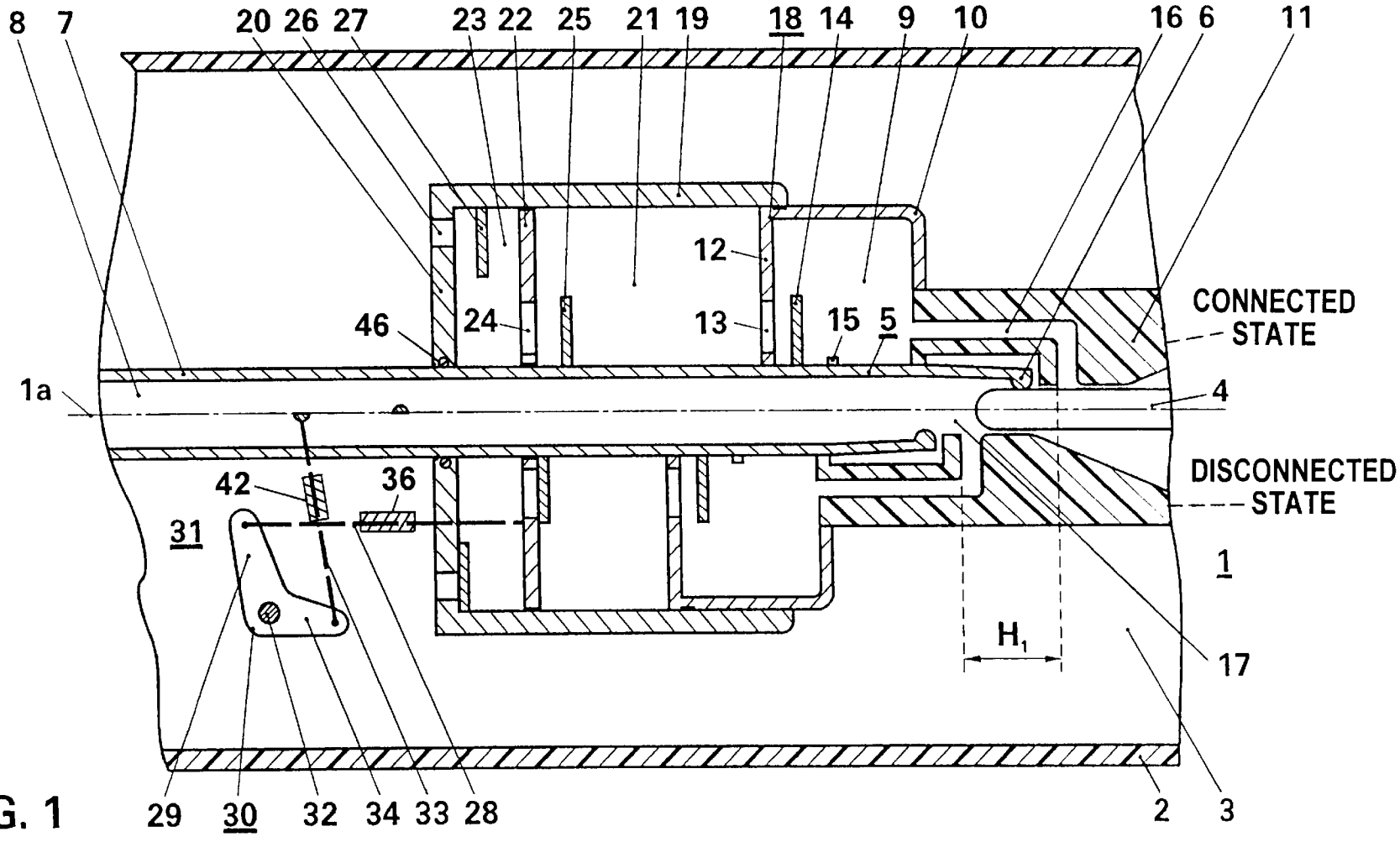
FIG. 1 shows a partial section through an arcing chamber of a power circuit-breaker, the arcing chamber being illustrated in the connected state in the left-hand half of the figure and in the disconnected state in the right-hand half of the figure.

Referring now to the drawings, wherein like reference numerals designate identical or corresponding parts throughout the several views, FIG. 1 shows a partial section through an arcing chamber 1 of a power circuit-breaker, the arcing chamber 1 being illustrated in the connected state in the left-hand half of FIG. 1 and in the disconnected state in the right-hand half of FIG. 1. The arcing chamber 1 is constructed such that it is essentially rotationally symmetrical and has a center axis 1*a*. The arcing chamber 1 is in this case enclosed by an insulated enclosure 2. The rated current path which is present as a rule is not illustrated, for clarity. The insulated enclosure 2 is closed off at both ends by metallic connecting flanges, which are likewise not illustrated. The insulated enclosure 2 encloses an arcing chamber volume 3 which is filled with $SF_6$ gas under pressure, for example at 6 bar. If the power circuit-breaker is used in a metal-encapsulated, gas-insulated, high-voltage installation, then it may be possible to dispense with the insulated enclosure 2 and in this case, under some circumstances, the metal encapsulation could bound the arcing chamber volume 3.

The arcing chamber 1 has an electrically conductive stationary contact 4 and an electrically conductive moving contact 5. However, in certain power circuit-breaker types, it is possible for the contact 4 likewise to be constructed such that it can move. The moving contact 5 is provided at the end facing the stationary contact 4 with contact elements 6 which rest resiliently on the stationary contact 4 when the arcing chamber 1 is closed, The moving contact 5 has a cylindrically constructed metallic shaft 7 which extends in the opposite direction to the stationary contact 4. Internally, the shaft, 7 has a cylindrically constructed outlet channel 8. The moving contact 5 carries out a travel $H_1$ during a switching movement. A blowout volume 9, of annular construction, is rigidly mounted externally on the shaft 7 of the moving contact 5. The blowout volume 9 is enclosed by an outer wall 10 into which an insulating nozzle 11 is incorporated on the side facing the stationary contact 4. On the side of the blowout volume 9 facing away from the stationary contact 4, said blowout volume 9 is closed off by a base 12 which is connected in a pressure-tight, manner to the outer wall 10 and to the shaft 7. The base 12 is provided with a valves This valve is illustrated schematically here by openings 13 which are closed by a valve disk 14 in the event of overpressure in the blowout volume 9. The travel of the valve disk 14 is limited in the axial direction by a stop 15 which is fitted to the shaft 7. At least one flow channel 16 is incorporated in the insulating nozzle 11 and connects the blowout volume 9, during disconnection, to a quenching zone 17 in which the arc then burns.

The outer wall 10, together with the base 12 of the blowout volume 9, forms a piston 18 which slides in a compression cylinder 19. The compression cylinder 19 is mounted rigidly in the arcing chamber 1 and is closed off on the side opposite the stationary contact 4 by a cylinder base 20. The shaft 7 of the moving contact 5 passes through the center of the cylinder base 20, this passage being designed in a pressure-tight manner using one of the known methods, such as an O-ring 46. A first compression volume 21 is adjacent to the base 12. The valve which is fitted in the base 12 allows gas to flow from the first compression volume 21 into the blowout volume 9 when the pressure in the blowout volume 9 is lower than that in the first compression volume 21. The first compression volume 21 is bounded on the side opposite the base 12 by an auxiliary piston 22.

A second compression volume 23 is located between the auxiliary piston 22 and the cylinder, base 20. The auxiliary piston 22 slides, protected against tilting, both in the compression cylinder 19 and on the shaft 7 of the moving contact 5, these sliding points being designed to be pressure-tight using one of the known methods. The auxiliary piston 22 is provided with a further valve which, if required, allows gas to flow from the second compression volume 23 into the first compression volume 21. This valve is illustrated schematically here by openings 24, which can be covered by means of a valve disk 25. The travel of the valve disk 25 in the axial direction is limited by a stop, which is not illustrated.

The cylinder base 20 likewise has a valve, which is illustrated schematically by openings 26 which connect the second compression volume 23 to the arcing chamber volume 3. The openings 26 are covered by means of a valve disk 27 when the pressure in the second compression volume 23 is greater than the pressure in the arcing chamber volume 3. The travel of this valve disk 27 is likewise limited in the axial direction by a stop, which is not illustrated.

As is indicated schematically by a line of action 28, the auxiliary piston 22 is connected to a first limb 29 of a bell crank 30. The bell crank 30 is part of a direction-changing device 31 which connects the auxiliary piston 22 to the shaft 7. The bell crank 30 is mounted on a bearing bolt 32 such that it can rotate. The bearing bolt 32 is rigidly secured in the arcing chamber 1. As is indicated schematically by a line of action 33, the shaft 7 is connected to a second limb 34 of the bell crank 30. One embodiment of the direction-changing device 31 will be described in somewhat more detail later; with reference to FIGS. 3 to 6.

Figure 2:
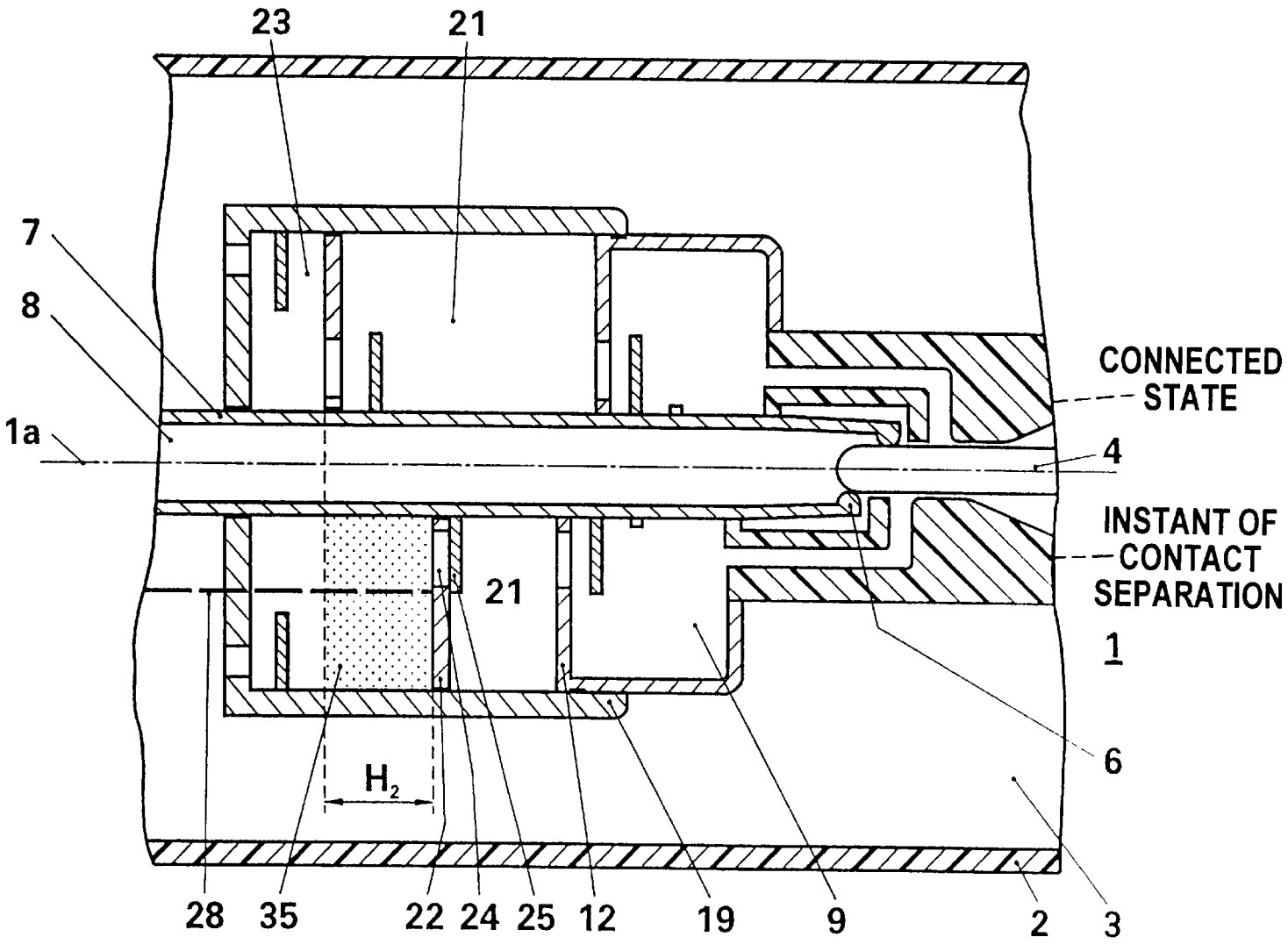
FIG. 2 shows a partial section through an arcing chamber of a power circuit-breaker, said arcing chamber being shown in the connected state in the left-hand half of the figure and at the instant of contact separation in the right-hand half of the figure.

FIG. 2 shows a partial section through an arcing chamber 1 of a power circuit-breaker, the arcing chamber 1 being illustrated, as in FIG. 1, in the connected state in the eft-hand half of FIG. 2 and at the instant of contact separation in the right-hand half of FIG. 2. The auxiliary piston 22 which is moved via the direction-changing device 31 and whose drive is indicated by the line of action 28 has moved from the original position, which is illustrated in the left-hand half, into its uppermost position, which is illustrated in the right-hand half The direction-changing device 31 is designed in the case of this exemplary embodiment such that the auxiliary piston 22 moves through the travel $H_2$ in the direction of the stationary contact 4. Other travels are also possible different limb lengths of the bell crank 30 can be used to optimize the movement of the auxiliary piston 22 for the respective type of power circuit-breaker. The angle which is formed between the two limbs 29 and 34 can likewise be modified as well in order to optimize the movement of the auxiliary piston 22. In the case of this travel $H_2$, the auxiliary piston 22 has compressed the $SF_6$ gas in the first compression volume 21. The volume 35, which is illustrated by dots, represents the quantity of gas before compression, and this corresponds to the quantity of the $SF_6$ gas which is additionally compressed by the auxiliary piston 22 in the first compression volume 21. During the movement of the auxiliary piston 22 upward, $SF_6$ gas is fed out of the arcing chamber volume 3, through the openings 26, into the second compression volume 23 so that no pressure difference can form between said compression volume 23 and the arcing chamber volume 3.

It is now intended to consider the direction-changing device 31 in somewhat more detail, with reference to FIGS. 3 to 6. As already described the bell crank 30 is mounted on the stationary bearing bolt 32 such that it can rotate. As can be seen from FIG. 4, two bell cranks 30 are provided in order to prevent tilting of the auxiliary piston 22 and one piston rod 36 is articulated on each bell crank 30. At their other end, which cannot be seen here, these piston rods 36 are connected in an articulated manner to the auxiliary piston 22 in a pressure-tight manner using one of the known methods as described above. The piston rods 36 are arranged in the region alongside the shaft 7. The piston rods 36 each have a longitudinal axis 37, and these longitudinal axes 37 lie on a plane. As a rule, the center axis 1*a* does not lie on this plane. The piston rods 36 are each articulated on the first limb 29 of the bell crank 30. A bolt 38, which has a collar 39 at one end and a circlip 40 at the other end as a securing device, connects each of the piston rods 36 to the first limb 29 of the bell crank 30, such that they can rotate.

Figure 4:
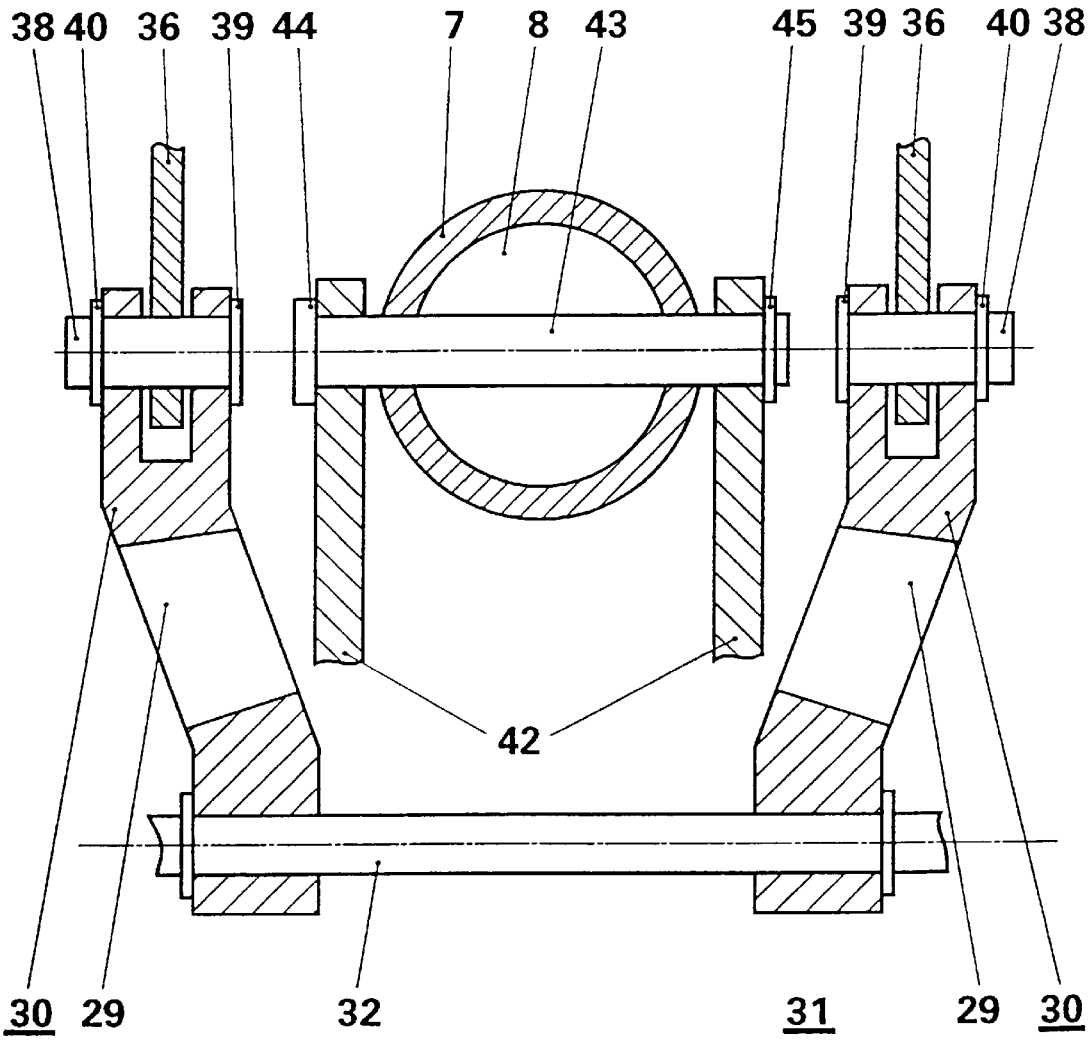
FIG. 4 shows various partial sections through the direction-changing device which is indicated in FIG. 1.
Figure 6:
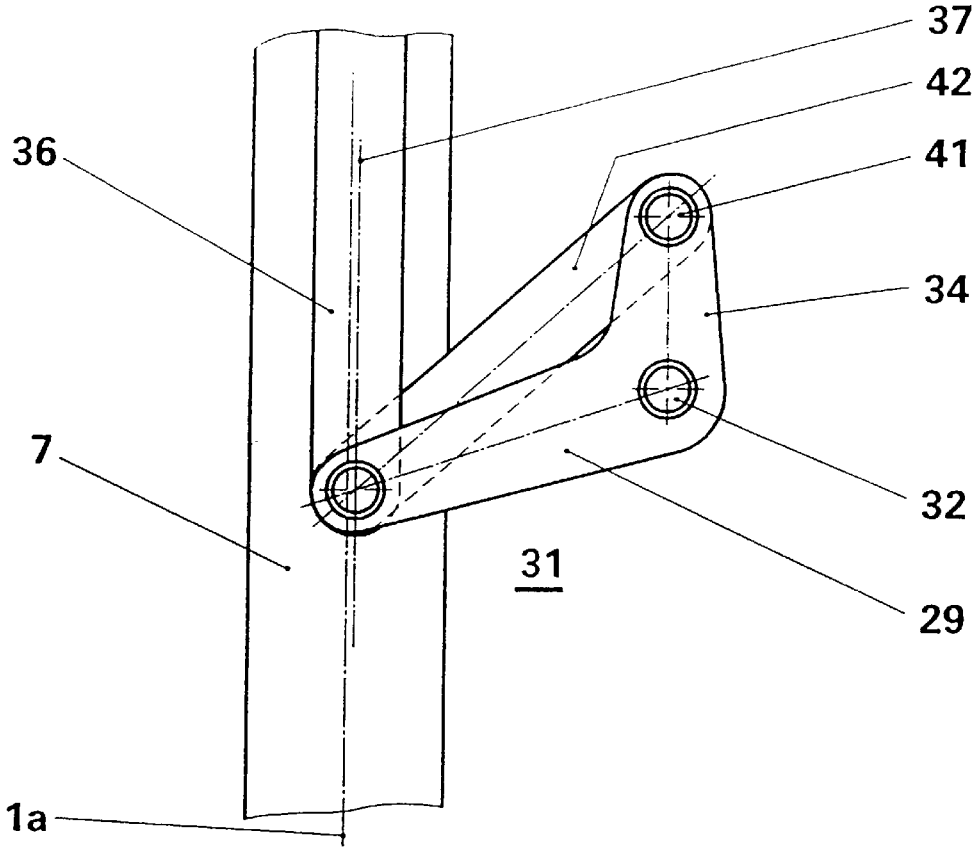
FIG. 6 shows a schematic illustration of the direction-changing device, which is indicated in FIG. 1, when the arcing chamber is disconnected.

A bolt 41 connects in each case one rod 42 to the respective second limb 34 of the two bell cranks 30, such that they can rotate. This bolt connection is of similar construction to the connection described in the preceding paragraph. The other ends of the rods 42 are in each case articulated on one side of the shaft 7. The rods 42 are arranged on both sides of the shaft 7. A bolt 43 passes through the shaft 7 and the other ends of the rods 42. The bolt 43 has a collar 44 at one end and a circlip 45 at the other end as a securing device. As can also be seen from FIG. 4, those ends of the rods 42 through which the bolt 43 passes run in the region immediately alongside the shaft 7, while, because of the crank in the first limbs 29 of the bell cranks 30, the piston rods 36 are at a somewhat greater distance from the shaft 7. The partial sections which are illustrated in FIG. 4 do not lie on the same planes.

Figure 3:
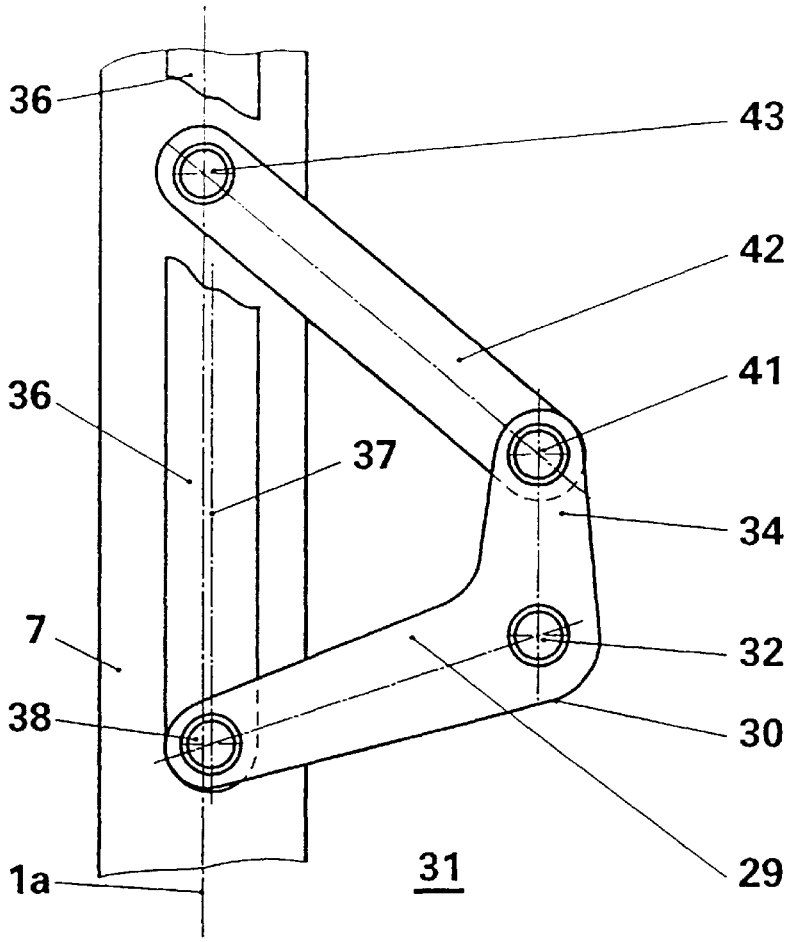
FIG. 3 shows a schematic illustration of the direction-changing device, which is indicated in FIG. 1 for operation of an auxiliary piston when the arcing chamber is connected.
Figure 5:
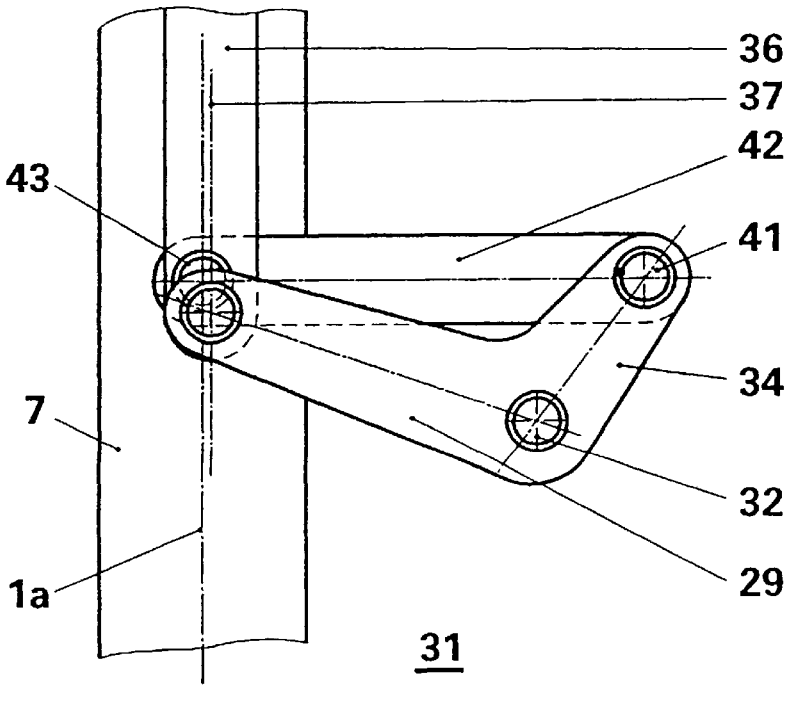
FIG. 5 shows a schematic illustration of the direction-changing device, which is indicated in FIG. 1, at the instant of contact separation in the arcing chamber.

FIG. 5 shows a further schematic illustration of the direction-changing device 31, which is illustrated in FIG. 3, at the instant of contact separation in the arcing chamber 1. The bolt 43 has been driven with the shaft 7, which has moved downward, and has moved the rods 42 with it. The bell cranks 30 have rotated clockwise around the bearing bolt 32, operated by the rods 42. The piston rods 36 have as a consequence of this been moved upward and, with them, the auxiliary piston 22 which is now located in the uppermost position illustrated in the right-hand half of FIG. 2. When the shaft 7 moves further downward in the course of the disconnection movement, then the bell cranks 30 are now moved further in the counterclockwise direction, via the rods 42. The consequence of this is that the auxiliary piston 22 is likewise moved downward again, via the piston rods 36. This movement is continued until the direction-changing device 31 reaches the disconnected position shown in FIG. 6. The auxiliary piston 22 has now reached its original position again. The auxiliary piston 22 assumes the same position as is illustrated in the left-hand half of FIG. 1 both when the arcing chamber 1 is connected and when the arcing chamber 1 is disconnected.

Figure 7:
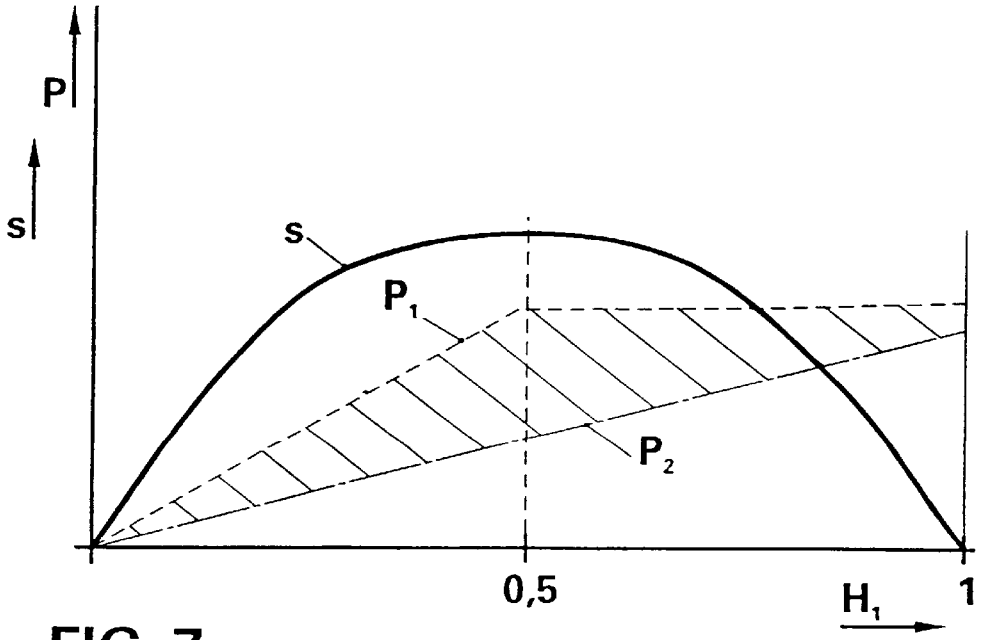
FIG. 7 shows the movement of the auxiliary piston and pressure profiles in the blowout volume as a function of the travel of the arcing chamber of the power circuit-breaker.

FIG. 7 illustrates the movement s of the auxiliary piston 22 as a function of the travel $H_1$ of the arcing chamber 1. The idealized profile of the pressure $P_1$ in the blowout volume 9 is furthermore illustrated as a function of the travel $H_1$ of the arcing chamber 1 of the power circuit-breaker. The pressure $P_1$ in the blowout volume 9 has already reached its maximum value, in the case of the present exemplary embodiments when half the travel of the arcing chamber 1 has been reached, if the auxiliary piston 22 has reached its uppermost position, and remains at this maximum value subject to the precondition that there is still no flow out of the blowout volume 9 and that leaks which are always present can be ignored. The pressure profile $P_2$ is achieved in the case of a power circuit-breaker having a conventional piston/cylinder arrangement without the additional auxiliary piston 22. The shaded area between the pressure profiles $P_1$ and $P_2$ indicates clearly that, in the case of the power circuit-breaker according to the present exemplary embodiment, a considerably greater quantity of pure $SF_6$ gas is stored, under pressure for blowing out the arc, in the blowout volume 9 and in the first compression volume 21.

In the following description of the method of operation, the influence of leaks on the portrayal of the pressure buildup is ignored. This approximation makes sense since the described disconnection process always takes place in a comparatively short time, for example in the range from about 10 ms to a maximum of 30 ms. In this case, the natural response time of the respective power circuit-breaker has not been included in the time required for the disconnection process. During disconnection, the moving contact 5 moves downward, driven by a drive which is not illustrated, the $SF_6$ gas being compressed in the first compression volume 21 by the piston 18. At the same time, the auxiliary piston 22, which is operated by the moving contact 5 via the described direction-changing device 31, moves upward and likewise compresses the $SF_6$ gas in the first compression volume 21. At the same time, the auxiliary piston 22 additionally pumps the $SF_6$ gas, corresponding to the volume 35, into the first compression volume 21 and into the blowout volume 9. At the same time, the pressure $P_1$ builds up in the first compression volume 21, as is illustrated in FIG. 7. In this movement phase, the blowout volume 9 is connected by the openings 13 to the first compression volume 21, so that the same pressure $P_1$ is present in both volumes. During the upward movement of the auxiliary piston 22, the openings 24 are closed by the valve disk 25, but pure $SF_6$ gas flows through the openings 26 in this movement phase, out of the arcing chamber volume 3 into the second compression volume 23.

Once the auxiliary piston 22 has reached its uppermost position, the pressure rise is complete as a result of the mechanical compression in the first compression volume 21 and thus in the blowout volume 9 as well, and the second compression volume 23 is furthermore filled with $SF_6$ gas again, which is at the same pressure as that which prevails in the arcing chamber volume 3. In the case of the present exemplary embodiment, contact separation takes place at this moment when the maximum mechanically produced compression pressure is reached, and the auxiliary piston 22 at the same time reverses its movement direction. An arc is produced immediately in the quenching zone 17 on contact separation. The procedure for blowing out the arc is different in the case of this power circuit-breaker, depending on whether the arc to be interrupted is a heavy-current arc or a weak-current arc.

A weak-current arc does not significantly heat the quenching zone 17, that is to say the pressure of the $SF_6$ gas in the quenching zone 17 is increased only insignificantly by a weak -current arc, so that a pressure gradient exists between the blowout volume 9 and the quenching zone 17. The arc is blown out intensively immediately after contact separation as a result of this pressure gradient. The pure $SF_6$ gas which is stored under pressure in the blowout volume 9 and in the first compression volume 21 flows through the flow channels 16 into the quenching zone 17 and cools the arc there. After this, the $SF_6$ gas flows out through the outlet channel 8 and through the insulating nozzle 11 in the direction of the arcing chamber volume 3. This outward flow would cause a pressure drop in the blowout volume 9 and in the first compression volume 21 if the piston 18 were not to compress further the $SF_6$ gas in the first compression volume 21 in the course of its further disconnection movement, and thus compensate for the pressure drop. A pressure increase occurs in the second compression volume 23 during the downward movement of the auxiliary piston 22, which results in the openings 26 being closed by the valve disk 27. The pressure in the second compression volume 23 continues to increase until pressure equalization takes place between the first compression volume 21 and the second compression volume 23, that is to say until the maximum value of the pressure $P_1$ also prevails in the second compression volume 23. From this point until the end of the disconnection movement, the piston 18 acts both on the first compression volume 21 and on the second compression volume 23.

However, if a heavy-current arc occurs after contact separation, then the $SF_6$ gas which is located in the quenching zone 17 is heated very severely by the thermal energy of this arc. This heating produces a pressure in the quenching zone 17, which pressure is considerably above the maximum value of the pressure $P_1$ so that no $SF_6$ gas can flow out of the blowout volume 9 into the quenching zone 17. In contrast, the $SF_6$ gas which has been heated in the quenching zone 17 flows through the flow channels 16 into the blowout volume 9, so that the pressure in the blowout volume 9 is considerably increased. This pressure increase results in the openings 13 being closed by the valve disk 14, so that the hot, and correspondingly contaminated, $SF_6$ gas cannot pass into the first compression volume 21. The hot $SF_6$ gas mixes in the blowout volume 9 with the stored cold $SF_6$ gas and is thereby cooled somewhat. Pure $SF_6$ gas is maintained under pressure in the first compression volume 21, this pressure rising somewhat beyond the maximum value of $P_1$ indicated in FIG. 7 under the influence of the piston 18, which continues to move in the disconnection direction.

When the current feeding the arc approaches a zero crossing, then its intensity is reduced and the production of pressurized hot gas is thus also reduced. The hot gas flows out of the quenching zone 17, through the outlet channel 8 and through the insulating nozzle 11. If the heating is not as severe, then this outward flow leads to a reduction in the pressure prevailing in the quenching zone 17. As soon as the pressure which is stored in the blowout volume 9 is undershot in the quenching zone 17, then the mixture of hot and cold $SF_6$ gas which is stored in the blowout volume 9 flows through the flow channels 16 into the quenching zone 17 and blows out the arc there very effectively,, and the pressure in the blowout volume 9 in consequence falls. As soon as pressure equalization has taken place between the blowout volume 9 and the first compression volume 21, the valve disk 14 releases the openings 13 and the pure cold gas which is stored in the first compression volume 21 and in the second compression volume 23 flows through the flow channels 16 into the quenching zone 17 and assists the blowing out of the arc there. If disconnection is successful, the arc is quenched at the current zero crossing. The pure cold gas which continues to flow improves the dielectric strength of the quenching zone 17 so that the arc is reliably prevented from being struck again after it has been quenched. The arcing chamber 1 can now withstand the rise in the returning voltage which occurs between the stationary contact 4 and the moving contact 5.

If there is any need to be concerned that the blowout volume 9 could be subjected to an excessive pressure load, then an overpressure valve can be fitted in the base 12, which overpressure valve operates when the pressure exceeds a predetermined limit value, and allows the pressure to escape into the first compression volume 21. The overpressure valve can also be fitted in the outer wall 10 of the blowout volume 9, to be precise in a region which cannot be covered by the compression cylinder 19, so that, if necessary, the overpressure can be dissipated into the arcing chamber volume 3. An overpressure valve can likewise be fitted in the auxiliary piston 22, which overpressure valve dissipates overpressure in the first compression volume 21 into the second compression volume 23, if a predetermined overpressure in the first compression volume 21 is exceeded. An overpressure valve can furthermore be fitted in the cylinder base 20 as well, which overpressure valve dissipates overpressure in the second compression volume 23 into the arcing chamber volume 3, if a predetermined overpressure in the second compression volume 23 is exceeded.

When the arcing chamber 1 is connected, the auxiliary piston 22 likewise produces an overpressure in the first compression volume 21 and in the blowout volume 9, so that the quenching zone 17 has fresh $SF_6$ gas blown into it before the contacts meet. This blowing results in the pre-arcing arc which occurs during connection taking place somewhat later. This effect is advantageous particularly in the case of O-C-O switching cycles, since, in this case, any conductive particles which may still remain in the quenching zone 17 from the preceding disconnection are blown away out of this region during the connection, so that they cannot have a dielectrically disturbing effect in the event of disconnection following immediately after the connection.

In the case of the present power circuit-breaker, a greater quantity of pure $SF_6$ gas is available for blowing out the arc than in the case of conventional power circuit-breakers, which results in a considerable increase in the disconnection capacity, the cost of this improvement being comparatively low in this case.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A power circuit-breaker comprising:

at least one cylindrically constructed arcing chamber which has a contact that is generally stationary, a moving contact, a quenching zone between the two contacts having a blowout volume which is permanently connected to a shaft of the moving contact and is closed off on the stationary contact side by an insulating nozzle through which at least one flow channel passes, said quenching zone having a first substantially pressure tight compression volume and valve means for independently operatively connecting disconnecting said first compression volume in cooperating flow communication to the blowout volume and to a second substantially pressure tight compression volume, respectively, and a moving auxiliary piston provided between the first compression volume and the second compression volume, wherein the auxiliary piston is connected to the moving contact via a direction-changing device.

2. The power circuit-breaker as claimed in claim 1, wherein the direction-changing device has at least one bell crank which is mounted on a stationary bearing bolt such that it can rotate and has two limbs, the first of the two limbs is connected in an articulated manner to the auxiliary piston via a piston rod, and the second of the two limbs is connected in an articulated manner to the shaft of the moving contact via a rod.

3. The power circuit-breaker as claimed in claim 2, wherein two bell cranks are mounted on the bearing bolt, each of which is connected to a piston rod and to a rod, the two rods are connected to the shaft by means of a bolt, one of the rods being arranged on each side of the shaft, and the two piston rods are likewise passed to the auxiliary piston on both sides of the shaft, outside the region of the rods.

4. The power circuit-breaker as claimed in claim 3, wherein the direction-changing device is designed such that the auxiliary piston moves in the opposite direction to the movement direction of the moving contact at the start of the disconnection movement, and the auxiliary piston moves in the same direction as the moving contact after reversal of the movement direction.

5. The power circuit-breaker as claimed in claim 3, wherein each said limb of each said bell crank has a predetermined length and the lengths of the limbs of the bell cranks can be changed to obtain a movement profile of the auxiliary piston that is matched to predetermined operating requirements.

6. The power circuit-breaker as claimed in claim 3, wherein the auxiliary piston is provided with a check valve which blocks any gas flow from the first compression volume in the direction of the second compression volume.

7. The power circuit-breaker as claimed in claim 4, wherein the blowout volume is provided with a first valve, the first compression volume is provided with a second valve, which is fitted in the auxiliary piston, and the second compression volume is provided with a third valve, which is fitted in the cylinder base.

8. The power circuit-breaker as claimed in claim 1 wherein clean gas is charged with pressure in the second compression volume so as to increase the blowing on the arc.

9. A power circuit-breaker comprising:

at least one cylindrically constructed arcing chamber which has a contact that is generally stationary, a moving contact, a quenching zone between the two contacts having a blowout volume which is permanently connected to a shaft of the moving contact and is closed off on the stationary contact side by an insulating nozzle through which at least one flow channel passes, said quenching zone having a first substantially pressure tight compression volume which is independently operatively connected and disconnected in cooperating flow communication to the blowout volume and to a second substantially pressure tight compression volume, respectively, and a moving auxiliary piston provided between the first compression volume and the second compression volume, wherein the auxiliary piston is connected to the moving contact via a direction-changing device, and wherein the blowout volume is provided with a first valve, the first compression volume is provided with a second valve, which is fitted in the auxiliary piston, and the second compression volume is provided with a third valve, which is fitted in the cylinder base.

* * * * *